US007726382B2

(12) United States Patent
Suzuki et al.

(10) Patent No.: US 7,726,382 B2
(45) Date of Patent: Jun. 1, 2010

(54) VEHICLE BODY FRAME, DIE-CAST PRODUCT, MOLD FOR DIE-CAST PRODUCT AND DIE-CAST METHOD

(75) Inventors: Toshimitsu Suzuki, Saitama (JP); Yoshitaka Seki, Saitama (JP); Jun Hariu, Saitama (JP); Shin Watanabe, Saitama (JP); Koichi Ota, Saitama (JP); Satoshi Hirayanagi, Saitama (JP); Takashi Doi, Saitama (JP); Yoshiyuki Kurayoshi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 619 days.

(21) Appl. No.: 11/605,389

(22) Filed: Nov. 29, 2006

(65) Prior Publication Data

US 2007/0131377 A1 Jun. 14, 2007

(30) Foreign Application Priority Data

Nov. 30, 2005 (JP) ..... 2005-346018

(51) Int. Cl.
*B22D 33/04* (2006.01)
*B22C 9/10* (2006.01)

(52) U.S. Cl. ..... 164/340; 164/369; 164/370

(58) Field of Classification Search ..... 164/339, 164/340, 369, 370, 397, 398
See application file for complete search history.

(56) References Cited

U.S. PATENT DOCUMENTS

| | | | | |
|---|---|---|---|---|
| 4,283,835 | A * | 8/1981 | Obrochta et al. | 29/527.6 |
| 4,913,217 | A * | 4/1990 | Koch et al. | 164/340 |
| 7,467,655 | B2 * | 12/2008 | Beddard et al. | 164/369 |
| 2001/0033104 | A1 | 10/2001 | Hummel et al. | |
| 2004/0094287 | A1 * | 5/2004 | Wang | 164/361 |

FOREIGN PATENT DOCUMENTS

| | | | |
|---|---|---|---|
| EP | 0 322 305 | A2 | 6/1989 |
| JP | 1-101282 | A | 4/1989 |
| JP | 1 101283 | A | 4/1989 |
| JP | 1-154857 | A * | 6/1989 |
| JP | 1-254479 | A | 10/1989 |
| JP | 2-251354 | A | 10/1990 |
| JP | 8-309481 | A | 11/1996 |
| JP | 2004-34092 | A | 2/2004 |

* cited by examiner

*Primary Examiner*—Kevin P Kerns
(74) *Attorney, Agent, or Firm*—Birch, Stewart, Kolasch & Birch, LLP

(57) ABSTRACT

A mold and a die-cast manufacturing method for the die-cast product, in which a main frame which is contiguously formed with a head pipe constitutes a portion of a hollow light-weight-metal-made vehicle-body frame. The mold includes a core for forming an inner space of the hollow vehicle-body frame. The core includes a core body and a plurality of splints mounted on the core body, the splints having approximately elliptical cross-sectional shapes. The long axes direction of ellipses of the splints are set parallel to a mold split surface of the mold. As a result, measurement of the positional accuracy of the splints is facilitated, a clearance between the splint and the mold can decrease by increasing the dimensional accuracy of splint mounting portions of the mold based on sizes of the splints, and the frame can be manufactured with high dimensional accuracy.

11 Claims, 6 Drawing Sheets

VEHICLE BODY FRAME, DIE-CAST PRODUCT, MOLD FOR DIE-CAST PRODUCT AND DIE-CAST METHOD

CROSS-REFERENCE TO RELATED APPLICATION

The present application claims priority under 35 U.S.C. §119 to Japanese Patent Application No. 2005-346018, filed Nov. 30, 2005, the entire contents of which are hereby incorporated by reference.

BACKGROUND OF THE INVENTION

1. Field of the Invention

The present invention relates to, for example, a vehicle body frame of a motorcycle or the like, a die-cast product which constitutes a portion of the vehicle body frame, and a mold and a die-cast method for the die-cast product.

2. Description of Background Art

Among vehicle body frames of motorcycles, some vehicle body frames are manufactured by casting using light-weight metal such as aluminum. In manufacturing such vehicle body frames by casting, since it is necessary to make the inside of the vehicle body frame hollow to achieve the reduction of weight, casting is performed by setting a sand core in a mold. (See, for example, JP-A-1-254479.)

The core includes splints for setting the core in the mold and the core is set in the mold by inserting the splints into the mold. However, there exists a drawback that it is difficult to reflect the positional accuracy of the splints to the mold in which the splints are mounted. Particularly, even a slight distortion of the mold attributed to heat causes the interference of the splint with a splint mounting portion of the mold. Accordingly, to prevent the occurrence of damages on the splints at the time of clamping the mold, it is a prerequisite to ensure a large clearance between the splint mounting portion of the mold and the splint. As a result, when the core is displaced due to a molten flow at the time of casting, there arises a drawback that a wall thickness of a product becomes non-uniform.

SUMMARY AND OBJECTS OF THE INVENTION

Accordingly, it is an object of the present invention to provide a vehicle body frame, a die-cast product, and a mold and a die-cast method for the die-cast product which facilitate the measurement of the positional accuracy of splints, can decrease a clearance between the splint and the mold by increasing the dimensional accuracy of splint mounting portions of the mold based on sizes of the splints, and can manufacture the die-cast product of high dimensional accuracy.

To achieve the above-mentioned object, a first aspect of the present invention is directed to a mold for a die-cast product in which a main frame (for example, a main frame 3 in an embodiment) which is contiguously formed with a head pipe (for example, a head pipe 2 in the embodiment) constitutes a portion of a hollow light-weight-metal-made vehicle-body frame (for example, a vehicle body frame 1 in the embodiment). A core (for example, a core 20 in the embodiment) which serves to form an inner space of the die-cast product (for example, a die-cast product 11 in the embodiment) includes a core body (for example, a core body 21 in the embodiment) and a plurality of splints (for example, splints 22 in the embodiment) which are mounted on the core body and have an approximately elliptical cross-sectional shape, and the long axis direction of an ellipse of the splint is set parallel to a mold split surface (a mold split surface S in the embodiment) of the mold (the mold 10 in the embodiment).

As a result of this configuration, even when the mold expands due to heat, the influence of this heat largely appears in the longitudinal direction of the splints and the influence of the heat can be reduced to a small amount in the short-axis direction of the splints which influence a wall thickness of an outer wall of a hollow portion of the die-cast product. Therefore, change of the clearance between the splints and the mold can be reduced to a small amount.

According to a second aspect of the present invention, a main frame which is contiguously formed with a head pipe constitutes a portion of a hollow light-weight-metal-made vehicle-body frame. In addition, a core which serves to form an inner space of the die-cast product is constituted of a core body and a plurality of splints which are mounted on the core body and have an approximately elliptical cross-sectional shape, and side surfaces of the splints are formed into a flat surface (for example, a flat surface 23 in the embodiment) and all flat surfaces are set parallel to a mold split surface of the mold.

As a result, in clamping the molds, it is possible to hold the splints by sandwiching the flat surfaces of the splints on the mold split surface of both molds and hence, the core can be set at the accurate position.

According to a third aspect of the present invention, a die-cast product is manufactured by sandwiching the core by a fixed mold and a movable mold. As a result, it is possible to easily fix the splints by setting the splints at the mold split surface of the fixed mold and the movable mold.

According to a fourth aspect of the present invention, a main frame which is contiguously formed with a head pipe constitutes a portion of a hollow light-weight-metal-made vehicle-body frame. As a result, it is possible to enhance the dimensional accuracy of the vehicle body frame around a handle.

According to a fifth aspect of the present invention, a portion of a main frame which is contiguously formed with a head pipe constitutes a light-weight-metal-made vehicle body frame which is formed into a hollow shape by mold using a core. In addition, at least an opening portion (for example, an opening portion 43 in the embodiment) for a core hold pin (for example, a core hold pin 40 in the embodiment) is formed in the vehicle body frame, and the opening portion is formed by penetration parallel to the mold opening direction of the mold and straightly. As a result, it is possible to manufacture the vehicle body frame by effectively supporting the core using core hold pins from portions where the openings are formed.

According to a sixth aspect of the present invention, in the vehicle body frame which is manufactured by the mold, a hole (for example, a set pin hole 31 in the embodiment) for a set pin (for example, a set pin 30 in the embodiment) for holding the core is formed in a die-cast portion. As a result, it is possible to effectively make use of the set-pin holes as sand discharging ports.

ADVANTAGE OF THE INVENTION

According to the first aspect of the invention, even when the mold expands due to heat, the influence of this heat largely appears in the longitudinal direction of the splints and the influence of the heat can be reduced to a small amount in the short-axis direction of the splints which influences a wall thickness of an outer wall of a hollow portion of the die-cast product. Accordingly, it is possible to reflect the accuracy of the splints to the mold by suppressing a change of clearance between the splint and the mold to a small amount whereby it is possible to obtain an advantageous effect that the vehicle body frame having the highly accurate die-cast portion can be manufactured. Further, since the long-axis direction is set parallel to the mold split surface, it is possible to easily perform the measurement of the positional accuracy thus facilitating the measurement.

According to the second aspect of the present invention, in clamping the molds, it is possible to hold the splints by sandwiching the flat surfaces of the splints on the mold split surface of both molds and hence, the core can be set at the accurate position whereby it is possible to obtain an advantageous effect that the vehicle body frame having the highly accurate die-cast portion can be manufactured.

According to the third aspect of the present invention, it is possible to easily fix the splints by setting the splints at the mold split surface of the fixed mold and the movable mold and hence, it is possible to obtain an advantageous effect that an operation to set the core in the mold can be easily performed.

According to the fourth aspect of the present invention, it is possible to enhance the dimensional accuracy of the vehicle body frame around a handle and hence, it is possible to obtain an advantageous effect that an optimum handling performance can be imparted to the vehicle.

According to the fifth aspect of the present invention, it is possible to manufacture the vehicle body frame by effectively supporting the core using core hold pins from portions where the opening portions are formed and hence, a position of a hollow portion which is formed by the core can be accurately ensured whereby it is possible to obtain an advantageous effect that sizes of a thicknesses of walls which surround the hollow portion can be made uniform.

According to the sixth aspect of the present invention, it is possible to effectively make use of the set-pin holes as sand discharging ports and hence, it is possible to obtain an advantageous effect that an operation to discharge sand in the product can be efficiently performed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
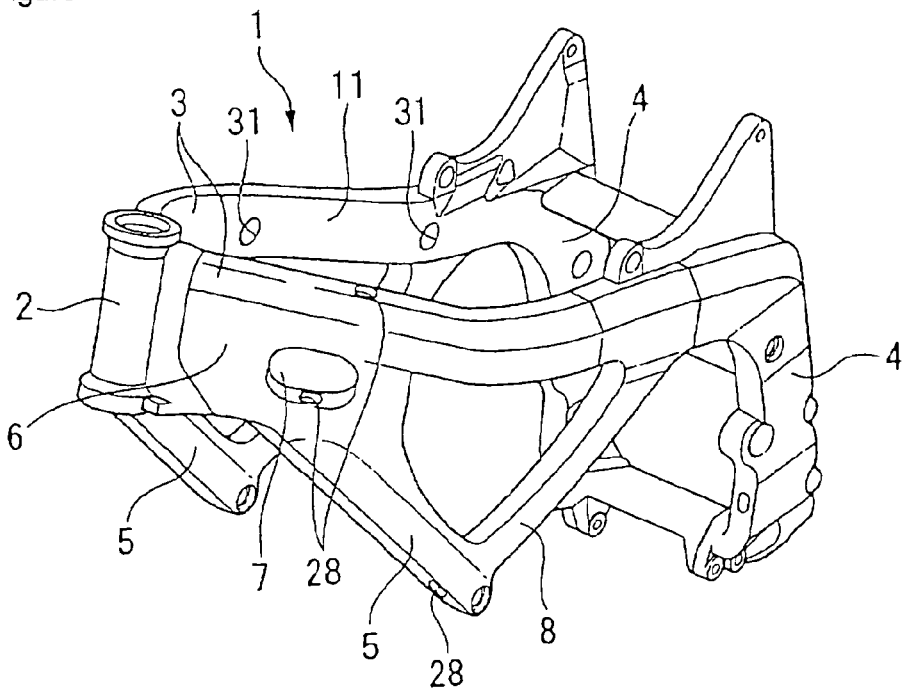
FIG. 1 is a front perspective view of a vehicle body frame of a motorcycle according to an embodiment of the present invention.

As shown in FIG. 1, a vehicle body frame 1 of a motorcycle includes a main frame 3 which is contiguously formed with a head pipe 2, and the vehicle body frame 1 is formed of a hollow die-cast product made of light-weight metal such as aluminum or aluminum alloy molded by high-pressure die-casting. To be more specific, a pair of left and right main frames 3, 3 is connected to the head pipe 2, and pivot plates 4, 4 which extend downwardly are connected to rear end portions of the respective main frames 3.

Engine hangers 5 extend obliquely downwardly from the head pipe 2, and the engine hangers 5 are connected with the main frames 3 by side wall portions 6. Opening portions 7 for introducing air are formed in the side wall portions 6. To lower ends of the engine hangers 5, support frames 8 which extend obliquely in the rearward and upward direction and are merged with the main frames 3, 3 are connected. Portions which range from front ends of the main frames 3 to front sides of upper end portions of the pivot plates 4 are formed into a hollow shape by the aluminum die-cast product, and the pivot plates 4 are joined to the aluminum die-cast product by welding.

Figure 2:
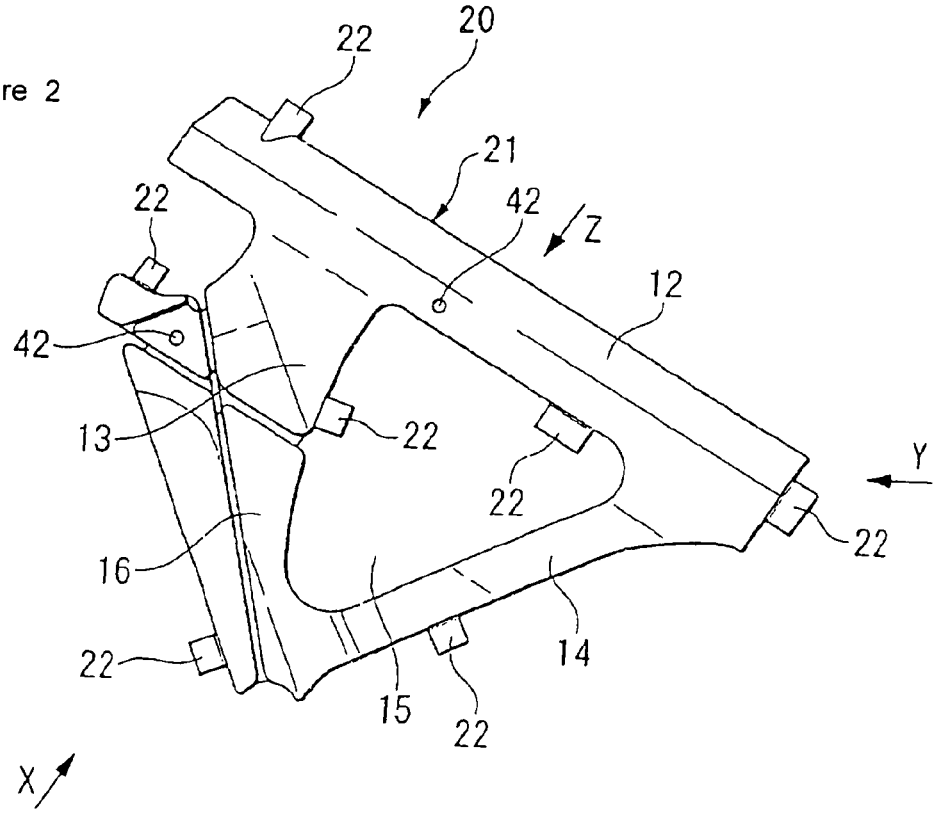
FIG. 2 is a front view of a core according to the embodiment of the present invention.
Figure 3:
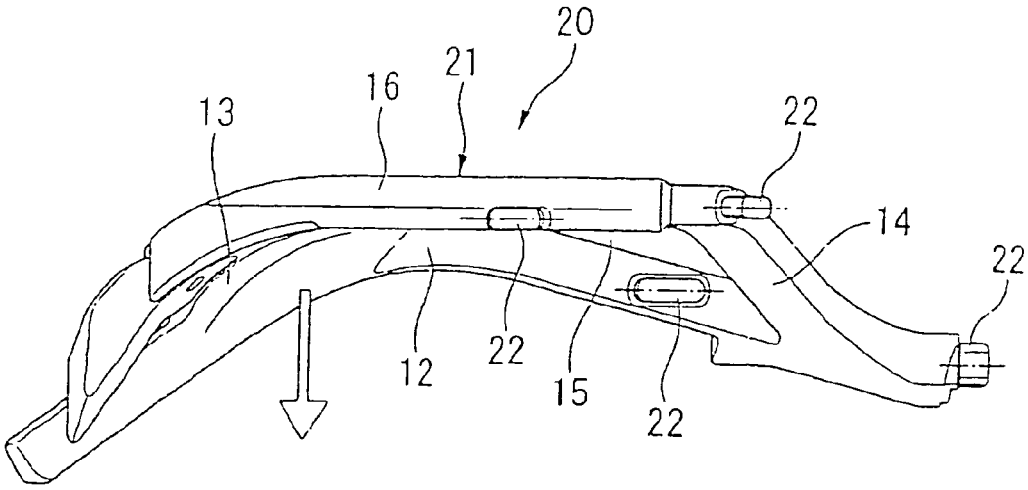
FIG. 3 is a view as viewed in the direction indicated by an arrow X in FIG. 2.
Figure 4:
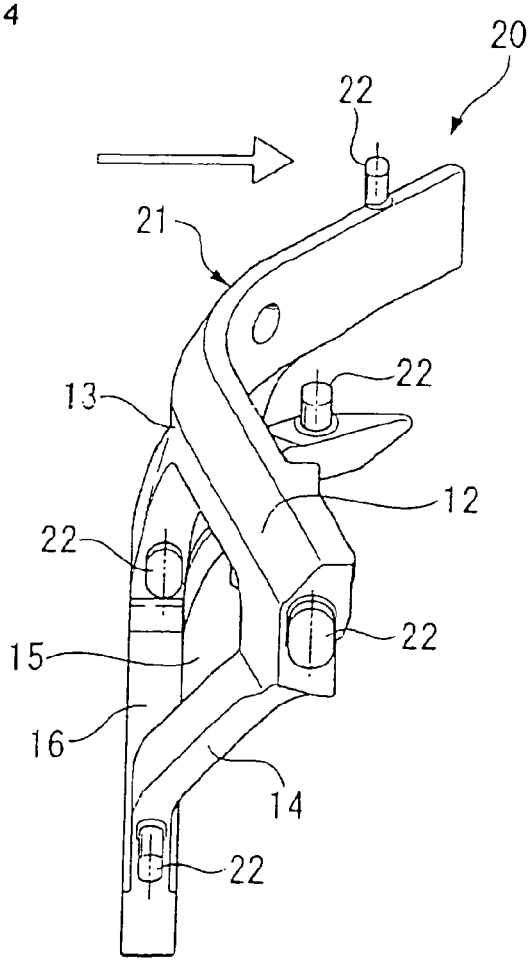
FIG. 4 is a view as viewed in the direction indicated by an arrow Y in FIG. 2.

FIG. 2 to FIG. 4 show a core 20 which is used in molding the vehicle body frame 1 using a mold. The core 20 serves to form an inner space of the die-cast product 11 which constitutes a portion of the vehicle body frame 1, wherein the core 20 is constituted of a curved main frame portion 12 which forms a hollow portion of the main frame 3, a side wall portion 13 which forms a hollow portion of the side wall portion 6, a support frame portion 14 which forms a hollow portion of the support frame 8, and an engine hanger portion 16 which forms a hollow portion of the engine hanger 5 such that these portions surround a triangular opening portion 15. The core 20 is molded by baking casting sands which are covered with an adhesive agent and is constituted of a core body 21 which constitutes portions corresponding to respective portions of the vehicle body frame 1, and splints 22 which are mounted on the mold 10 to prevent the floating of the core body 21.

To be more specific, the splints 22 are respectively formed in an approximately columnar shape on two portions at an upper portion of a distal end and a rear end surface of the main frame portion 12, on two portions in the periphery of the opening portion 15 which constitute a lower portion of the main frame portion 12 and a rear portion of the side wall portion 13, and on one portion around a portion where the opening portion 7 of the vehicle body frame 1 is formed, on one portion at a lower portion of the support frame portion 14, and on one portion at a front portion of a lower end of the engine hanger portion 16.

Here, the splints 22 are set such that all of long-axis directions of elliptical cross-sectional shapes of the respective splints 22 are arranged parallel to each other (see chained lines in FIG. 3 and FIG. 4), these splints 22 are arranged parallel to a mold split surface S described later, and the core 20 is set in the mold 10 such that the core 20 is sandwiched by the mold 10 at the time of clamping the mold 10. Here, in FIG. 3 and FIG. 4, an arrow indicates a mold removing direction.

Figure 5:
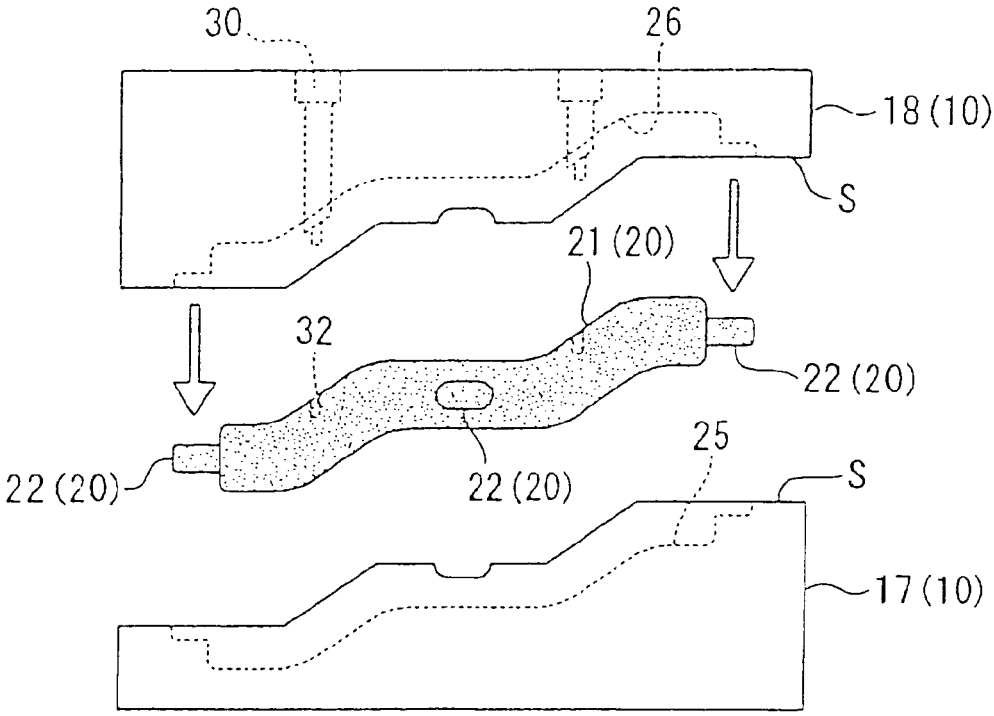
FIG. 5 is a cross-sectional explanatory view schematically showing a mold together with the core in a half opened state.
Figure 6:
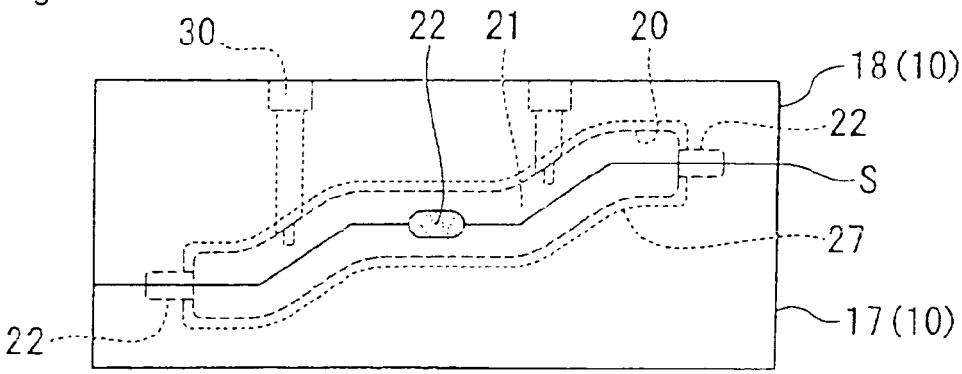
FIG. 6 is a cross-sectional explanatory view showing a mold clamped state in FIG. 5.
Figure 7:
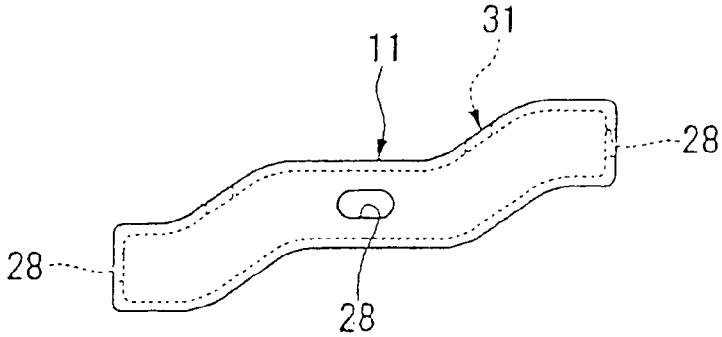
FIG. 7 is a side view of a die-cast product which is taken out after mold clamping in FIG. 5.

FIG. 5 to FIG. 7 schematically show the core 20 and the mold 10 which uses the core 20 for facilitating the explanation of the present invention.

The mold 10 is configured such that a movable mold 18 can be advanced to and retracted from a fixed mold 17. A fixed mold molding portion 25 which forms a profile of the vehicle body frame 1 is formed on the fixed mold 17, while a movable mold molding portion 26 which forms the profile of the vehicle body frame 1 is also formed on the movable mold 18. By clamping the fixed mold 17 and the movable mold 18 by a pair of molding portions 25, 26, a cavity 27 is formed in the inside of the molding portions 25, 26, and by arranging the core 20 in the inside of the cavity 27, it is possible to mold the die-cast product 11 which constitutes the hollow vehicle body frame 1.

Figure 8:
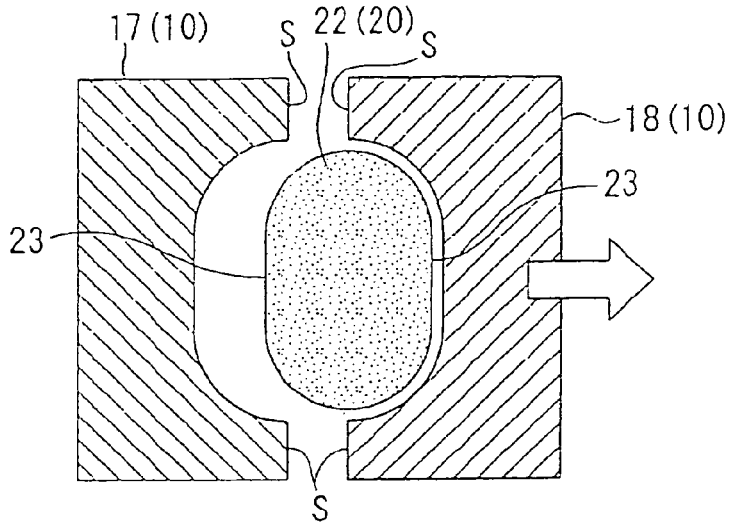
FIG. 8 is an end surface view of a splint of the core.
Figure 9:
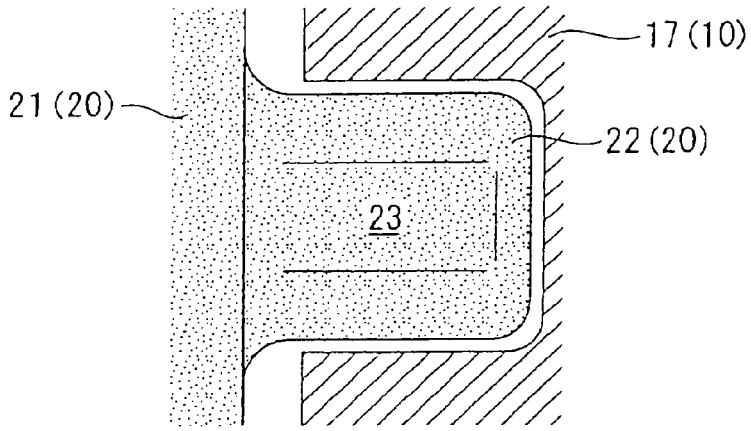
FIG. 9 is a side view of the splint of the core.
Figure 10:
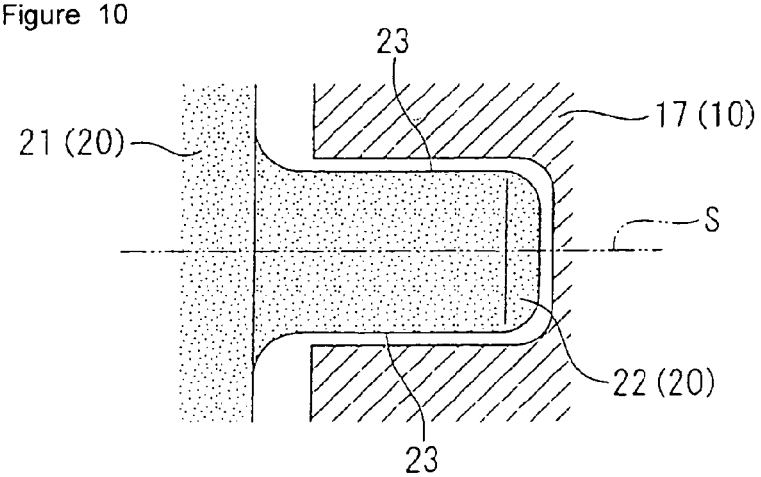
FIG. 10 is a front view of the splint of the core.

As shown in FIG. 5, the splints 22 are provided to both end portions and a center portion of the core 20, wherein these splints 22 are provided for preventing the floating of the core 20 in which a set pin 30 which is provided to the movable mold 18 is inserted. As shown in FIG. 8, each splint 22 is formed in an approximately elliptical cross section, to be more specific, as shown in FIG. 9, in an elongated oval cross section which forms a flat surface 23 on upper and lower surfaces. Further, the respective splints 22 are provided to the core body 21 such that long axes of the respective elliptical shapes are arranged parallel to each other. A distal end portion of the splint 22 is formed to exhibit a shape with round corner portions as viewed in a side view as shown in FIG. 9 as well as in a front view as shown in FIG. 10, while a proximal portion side of the splint 22 is gently contiguously formed with the core body 21. Then, as shown in FIG. 10, the core 20 is set in the mold 10 such that the long axes of the elliptical shapes of the splints 22 having such cross-sectional shape are aligned with the mold split surface S.

Then, as shown FIG. 6, in a state that the core 20 is set in the fixed mold 17 and the movable mold 18, the mold 10 is clamped and, thereafter, molten material is filled between the core 20 and the cavity 27 under pressure to obtain the die-cast product 11 shown in FIG. 7. Here, splint holes 28 are formed in portions of the die-cast product 11 which correspond to the splints 22 of the core 20.

Figure 11:
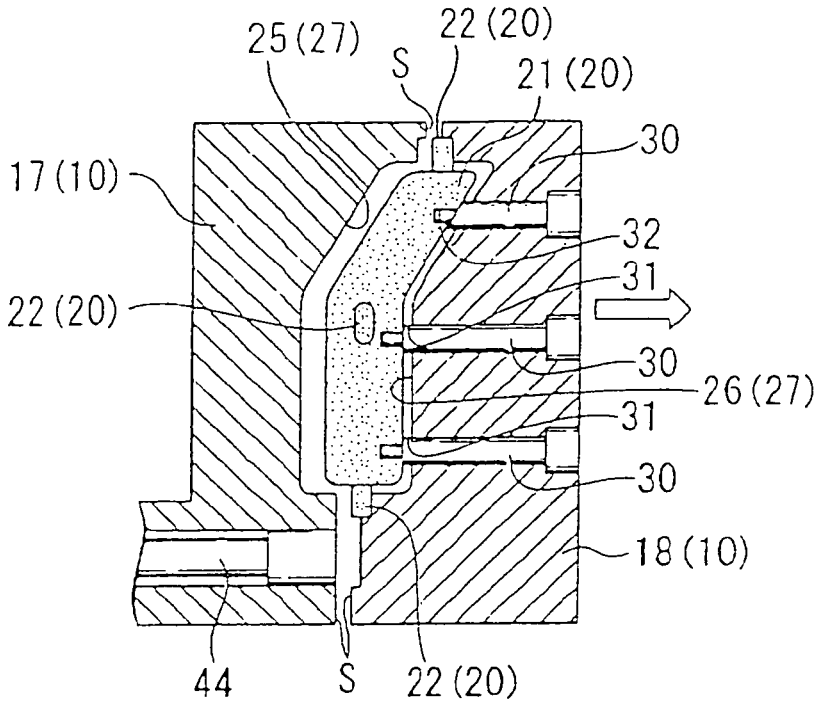
FIG. 11 is a cross-sectional view of the mold as viewed from a set-pin arrangement portion side.
Figure 12:
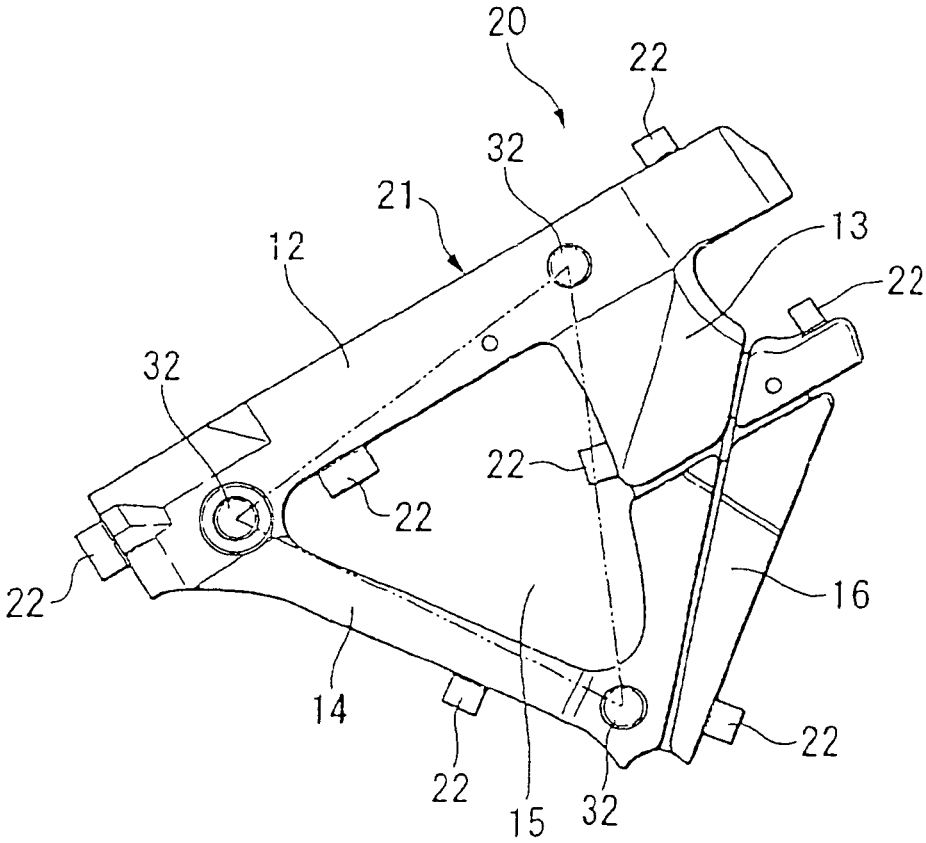
FIG. 12 is a back view of the core.

As shown in FIG. 11, 12, the set pins 30 for the core 20 are provided to the movable mold 18 along the mold removing direction (indicated by an arrow). The set pins 30 are provided for preventing the displacement of the setting of the core 20 and, as shown in FIG. 12, are provided to a distal end portion of the main frame portion 12, the vicinity of a joining portion between the main frame portion 12 and the support frame portion 14, and the vicinity of the joining portion between the support frame portion 14 and the engine hanger portion 16. The arrangement positions of these set pins 30 surround the opening portion 15 of the core 20 and, at the same time, positions of the splints 22 which are provided in the periphery of the opening portion 15 assume positions which correspond to respective sides to support the core 20 in a well-balanced manner. That is, these set pins 30 are set such that the splints 22 assume the substantially right triangular arrangement on the core 20.

A diameter of the set pins 30 is set to a value which falls within a range from 20 mm to 25 mm, for example, and a distal end portion of the set pin 30 has a small diameter and is inserted into a recessed set pin hole 32 formed in the core 20. Although the set pins 30 form set pin holes 31 in the die-cast product 11, the set pin holes 31 are formed in the inside of the vehicle body frame 1 which constitutes the die-cast product 11 and hence, the set pin holes 31 are inconspicuous from the outside whereby merchantability is not lowered. At the same time, the set pin holes 31 can be effectively utilized as sand discharge ports. Here, the vicinity of the rear end portion of the main frame portion 12 is formed into a blind array and hence, the set pin hole 31 formed in such a portion has a slightly larger diameter for enhancing the sand removal performance compared to the set pin holes 31 formed in other portions.

Figure 13:
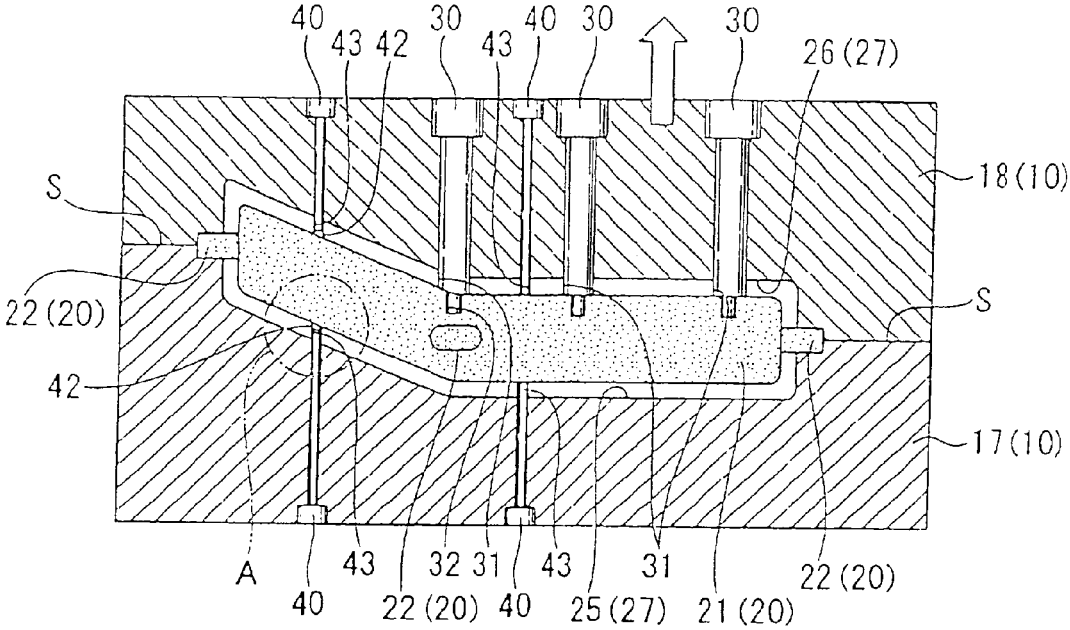
FIG. 13 is a cross-sectional view of the mold in which a core-hold-pin arrangement portion is viewed in the Z direction in FIG. 2.

As shown in FIG. 13, core hold pins 40 penetrate the movable mold 18 and the fixed mold 17 parallel to the mold removing direction at positions avoiding the set pin holes 30. These core hold pins 40 serve to support portions of the core 20 where an interval between the splints 22 is large in place of the splints 22. The core hold pins 40 have a diameter of approximately 8 mm, for example.

Figure 14:
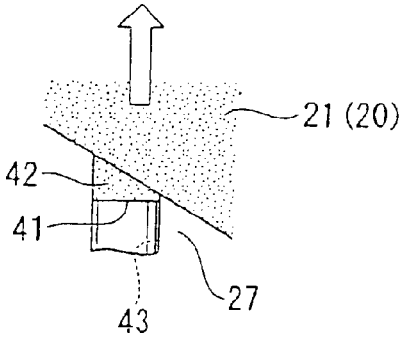
FIG. 14 is a enlarged cross-sectional view of a portion A in FIG. 13.

To be more specific, a pair of core hold pins 40, 40 which are arranged on one straight line from both of the movable mold 18 and the fixed mold 17 which are provided at a position where the core hold pins 40, 40 stride over the splints 22 which are formed on the front end portion of the main frame portion 12 and the splints 22 which are positioned in the periphery of the opening portion 15, while a pair of core hold pins 40, 40 which support an upper portion of the engine hanger portion 16 on one straight line from both of the movable mold 18 and the fixed mold 17 are provided in the same manner. An end surface of each core hold pin 40 is cut at a right angle, and on a portion of the core 20 with which the core hold pin 40 is brought into contact obliquely, as shown in FIG. 14, a pressing seat 42 which includes a surface 41 perpendicular to the mold removal direction (indicated by an arrow) is formed. Accordingly, the core hold pin 40 forms an opening portion 43 in the die-cast product 11.

Next, the method for manufacturing the die-cast product using the mold 10 and the core 20 is explained in conjunction with FIG. 11 and FIG. 13.

First of all, the set pins 30 provided to the movable mold 18 are inserted into the set pin holes 32 formed in the core 20 and, thereafter, the mold is clamped. Here, the core 20 is prevented from being floated in the inside of the mold 10 due to the splints 22 and, at the same time, is stably supported on the movable mold 18 by the set pins 30 which are arranged in a triangular shape. Further, the core 20 is also supported by the core hold pins 40 which penetrate the movable mold 18 and the fixed mold 17 and hence, the core 20 can be surely held in the inside of the cavity 27.

Next, a plunger 44 shown in FIG. 11 is allowed to advance and, at the same time, the cavity 27 is evacuated by vacuum suction. Simultaneously, a powdery mold removing agent is sprayed in the inside of the cavity 27.

Then, the plunger 44 is retracted to allow the supply of the molten material and, subsequently, vacuum suction is performed and the plunger 44 is advanced at a high speed to inject the molten material into the inside of the cavity 27. When the molten material is solidified, the mold is opened and the die-cast product 11 is taken out.

According to the mold 10 of the above-mentioned embodiment, the core 20 is constituted of the core body 21 and the plurality of splints 22 which are mounted on the core body 21 and have an approximately elliptical cross-sectional shape, and the long axis direction of an ellipse of the splint 22 is set parallel to the mold split surface S of the mold 10. Accordingly, even when the mold 10 is expanded due to heat, the influence of this heat largely appears in the long axis direction which is the longitudinal direction of the splints 22 and the influence of the heat can be suppressed to a small amount in the short-axis direction of the splints 22 which influences the wall thickness of the outer wall of the hollow portion of the die-cast product 11 thus reflecting the positional accuracy of the splints 22 to the mold 10.

As a result, the vehicle body frame 1 having the highly accurate die-cast product 11 can be manufactured. Further, since the long-axis direction of the splints 22 is set parallel each other, when the core 20 is mold, it is possible to easily perform the measurement of the positional accuracy of the splints 22 thus facilitating the measurement.

Further, the side surfaces of the splints 22 are formed into the flat surface 23 and all flat surfaces 23 are set parallel to the mold split surface S of the mold 10 and hence, in clamping the molds, it is possible to hold the splints 22 by sandwiching the flat surfaces 23 of the splints 22 on the mold split surface S of the mold 10 by the fixed mold 17 and the movable mold 18. Accordingly, the core 20 can be set at the accurate position. As a result, it is possible to manufacture the vehicle body frame 1 having the highly accurate die-cast portion.

Further, according to the die-cast casting method of this embodiment, by manufacturing the die-cast product 11 by sandwiching the core 20 by the fixed mold 17 and the movable mold 18, it is possible to easily fix the splints 22 by setting the splints 22 at the mold split surface S of the fixed mold 17 and the movable mold 18 and hence, it is possible to easily perform an operation to set the core 20 in the mold 10.

Accordingly, by using the die-cast product 11 which forms the highly accurate hollow portion using such a core 20 in the vehicle body frame 1 around the handle, it is possible to increase the accuracy of size around the handle whereby the optimum handling performance is imparted to the vehicle.

Here, the vehicle body frame 1 is the light-metal-made vehicle body frame 1 in which the portion of the main frame 3 which is contiguously formed with the head pipe 2 is formed into a hollow shape by the mold 10 using the core 20, and at least the opening portion 43 for the core hold pin 40 is formed in the vehicle body frame 1, and the opening portion 43 is formed by penetration parallel to the mold opening direction of the mold 10 and straightly. Accordingly, it is possible to manufacture the vehicle body frame 1 by effectively supporting the core 20 using core hold pins 40 from portions where the opening portions 43 are formed. As a result, a position of a hollow portion which is formed by the core 20 can be accurately ensured and hence, it is possible to make sizes of thicknesses of walls which surround the hollow portion uniform.

Further, the set-pin hole 31 for holding the core 20 is formed in a die-cast product 11 and hence, it is possible to effectively make use of the set-pin holes 31 as sand discharging ports whereby an operation to discharge sand in the die-cast product 11 can be efficiently performed.

Here, the present invention is not limited to the above-mentioned embodiment. For example, the embodiment is explained by taking the front portion of the vehicle body frame of the motorcycle as an example, the present invention is applicable to a lower portion of the vehicle body frame and other portions which form a hollow portion. Further, the present invention is not limited to the motorcycle and is applicable to a case in which a vehicle body frame of any vehicle is molded into a hollow shape using light weight metal.

What is claimed is:

1. A mold for a die-cast product in which a main frame which is contiguously formed with a head pipe constitutes a portion of a hollow light-weight-metal-made vehicle-body frame, comprising:

a core which serves to form an inner space of the die-cast product, the core including:

a core body; and at least one splint having an approximately elliptical cross-sectional shape mounted on each of at least two non-parallel, flat surfaces of the core body, wherein each of the splints projects orthogonally from the respective non-parallel, flat surface of the core body, wherein each of the elliptical cross-sectional shapes has a long axis direction set parallel to a mold split surface of the mold.

2. The mold for a die-cast product according to claim 1, further comprising a plurality of set pins penetrating through the mold for preventing displacement of the core.

3. The mold for a die-cast product according to claim 1, further comprising a plurality of set pins having diameters in a range of 20 mm to 25 mm, wherein ends of the set pins extend into a cavity between an inner surface of the mold and the core.

4. The mold for a die-cast product according to claim 1, further comprising a plurality of set pins of various lengths extending through the mold, wherein ends of the set pins having ends extend into a cavity between an inner surface of the mold and the core.

5. The mold for a die-cast product according to claim 1, wherein the long axis direction of each of the plurality of splints is arranged parallel to the long axis direction of every other one of the plurality of splints.

6. The mold for a die-cast product according to claim 1, wherein a cross-sectional area of each of the splints remains constant along an entire length thereof.

7. A mold for a die-cast product in which a main frame which is contiguously formed with a head pipe constitutes a portion of a hollow light-weight-metal-made vehicle-body frame, comprising:

a core which serves to form an inner space of the die-cast product, the core including:

a core body; and a plurality of splints mounted on the core body, the splints having approximately elliptical cross-sectional shapes, wherein side surfaces of the splints are formed into flat surfaces, and each of the flat surfaces is set parallel to a mold split surface of the mold, wherein at least one of the plurality of splints is mounted on each of two non-parallel surfaces of the core body, wherein each of the splints projects in a direction that is orthogonal relative to the respective non-parallel surface of the core body, and wherein a long axis direction of each of the plurality of splints is arranged parallel to the lone axis direction of every other one of the plurality of splints.

8. The mold for a die-cast product according to claim 7, further comprising a plurality of set pins penetrating through the mold for preventing displacement of the core.

9. The mold for a die-cast product according to claim 7, further comprising a plurality of set pins having diameters in a range of 20 mm to 25 mm, wherein ends of the set pins extend into a cavity between an inner surface of the mold and the core.

10. The mold for a die-cast product according to claim 7, further comprising a plurality of set pins of various lengths extending through the mold, wherein ends of the set pins having ends extend into a cavity between an inner surface of the mold and the core.

11. The mold for a die-cast product according to claim 7, wherein the flat surfaces of each of the splints are parallel to each other, and are parallel to and are disposed on opposite sides of a mold split surface of the mold.

* * * * *